US006246772B1

(12) United States Patent
Chang

(10) Patent No.: US 6,246,772 B1
(45) Date of Patent: Jun. 12, 2001

(54) WIRELESS HEADPHONE/SPEAKERS SOUND FIELD CONTROL CIRCUIT

(76) Inventor: Keng-Yuan Chang, No. 70, Chang-An 6th St., Taiping City, Taichung County (TW)

( * ) Notice: Subject to any disclaimer, the term of this patent is extended or adjusted under 35 U.S.C. 154(b) by 0 days.

(21) Appl. No.: 09/274,297

(22) Filed: Mar. 23, 1999

(51) Int. Cl.[7] ..... H04R 5/00

(52) U.S. Cl. ..... 381/1; 381/309; 381/311; 381/97

(58) Field of Search ..... 381/1, 2, 17, 18, 381/19, 309, 311, FOR 125, 94.2, 97, 98, 99, 100, 119, 307

(56) References Cited

U.S. PATENT DOCUMENTS

| | | | | |
|---|---|---|---|---|
| 4,087,629 | * | 5/1978 | Atoji et al. | 381/1 |
| 4,118,599 | * | 10/1978 | Iwahara et al. | 381/1 |
| 4,139,728 | * | 2/1979 | Haramoto et al. | 381/1 |
| 4,349,698 | * | 9/1982 | Iwahara | 381/1 |
| 4,817,162 | * | 3/1989 | Kihara | 381/97 |
| 4,980,914 | * | 12/1990 | Kunugi et al. | 381/1 |
| 5,119,420 | * | 6/1992 | Kato et al. | 381/1 |
| 5,121,433 | * | 6/1992 | Kendall et al. | 381/1 |
| 5,677,957 | * | 10/1997 | Hulsebus | 381/17 |
| 5,717,763 | * | 2/1998 | Choi et al. | 381/1 |
| 5,784,474 | * | 7/1998 | Kohut et al. | 381/97 |

FOREIGN PATENT DOCUMENTS

| | | | | |
|---|---|---|---|---|
| 61-187500 | * | 8/1986 | (JP) | 381/1 |

* cited by examiner

*Primary Examiner*—Xu Mei
(74) *Attorney, Agent, or Firm*—Rosenberg, Klein & Lee

(57) ABSTRACT

A wireless headphone/speakers sound field control system, which includes a wireless signal receiver, a left speaker connected to the wireless signal receiver through a left differential amplifier and a left variable resistor, and a right speaker connected to the wireless signal receiver through a right differential amplifier and a right variable resistor, each of the left and right variable resistors being respectively connected to the positive pole of each of the left and right differential amplifiers, wherein a phase-shifting circuit is connected between the left differential amplifier and the right differential amplifier, having two sub-circuits each formed of a first capacitor, a variable resistor, a second capacitor and a resistor, each sub-circuit being connected in series between the right or left variable resistor and the left or right differential amplifier, the phase-shifting circuit enabling the differential amplifiers to have a dual signal input, so that left sound channel signal is inputted into the right differential amplifier and right sound channel signal is inputted into the left differential amplifier to achieve a stereo effect.

3 Claims, 7 Drawing Sheets

WIRELESS HEADPHONE/SPEAKERS SOUND FIELD CONTROL CIRCUIT

BACKGROUND OF THE INVENTION

The present invention relates to a wireless headphone/speakers sound field control circuit, which improves stereo, sound-surround sound effect, and allows the user to adjust left/right, front/back sound field contrast.

FIGS. 1 and 2 show two different wireless headphone/speakers sound field control circuits according to the prior art. In FIG. 1, wireless signal receiver 1 is connected to a signal amplifier AMP through a variable resistor VR1, and left and right speakers L SP and R SP are respectively connected to the left channel output terminal and right channel output terminal of the signal amplifier AMP. Signal from the wireless signal receiver 1 is regulated through the variable resistor VR1, then amplified through the signal amplifier AMP, and then outputted through the speakers L SP and R SP. The variable resistor VR1 is for regulating the volume. This design has drawbacks. One drawback is that it has the functions of "receiving" and "amplification", however it is not capable of processing sound field. Another drawback of this design is that the stereo effect is determined subject to the signal source, and the stereo effect of received signal well be reduced after amplification. In FIG. 2, two differential amplifiers A1 and A2 are respectively connected between the wireless signal receiver 1 and the speakers L SP and R SP, and two variable resistors VRA1 and VRA2 are respectively connected between the wireless signal receiver 1 and the differential amplifiers A1 and A2 for volume control. This design also has numerous drawbacks. One drawback of this design is that the differential amplifiers A1 and A2 simply amplify stereo signals from the wireless signal receiver 1, however they cannot reprocess received signals, i.e., the differential amplifiers A1 and A2 cannot shift the phase of main sound, background sound, and sound-surround sound of main sound and background sound. The shifting of "phase" affects the stereo effect of sound field. Further, the variable resistors VRA1 and VRA2 can only adjust volume, they cannot adjust the direction of sound field, i.e., the stereo effect, as shown in FIG. 5, is shifted between left and right, but not between multiple directions of left and right/front and back.

SUMMARY OF THE INVENTION

The present invention has been accomplished to provide a wireless headphone/speakers sound field control circuit which eliminates the aforesaid drawbacks. The present invention achieves a multi-direction sound field effect. According to one aspect of the present invention, a phase-shifting circuit is connected between the left differential amplifier and the right differential amplifier, having two sub-circuits each formed of a first capacitor, a variable resistor, a second capacitor and a resistor, each sub-circuit being connected in series between the right or left variable resistor and the left or right differential amplifier. The phase-shifting circuit enables the differential amplifiers to have a dual signal input, so that left sound channel signal is inputted into the right differential amplifier and right sound channel signal is inputted into the left differential amplifier to achieve a stereo effect. Therefore, left main sound and right main sound are neutralized by phase shifting, and the sound-surround sound effect is improved. According to another aspect of the present invention, variable resistors are provided for enabling the user to adjust contrast conveniently. According to still another aspect of the present invention, received sound signal is reprocessed, so that output signals from the differential amplifiers provide better sound field contrast. According to still another aspect of the present invention, phase shifting control is stepless, and the adjustment can be made at the speakers by the user without through the main nit (signal source). Therefore, the invention enables the speakers to provide a stereo sound field effect, and allows the user to adjust sound field contrast directly at the speakers.

DETAILED DESCRIPTION OF THE PREFERRED EMBODIMENT

Referring to FIG. from 6 through 7, left and right speakers SP are respectively connected to a wireless signal receiver 1 through differential amplifiers A1 and A2 and variable resistors VRA1 and VRA2. The variable resistor VRA1 or VRA2 is connected to the positive terminal of the differential amplifier A1 or A2. A phase-shifting circuit 10 is connected between the negative pole of each of the variable resistor VRA1 and VRA2. The phase-shifting circuit 10 comprises a first circuit, which is comprised of capacitor C3, variable resistor VRB1, capacitor C1 and resistor R1 connected in series between the right variable resistor VRA2 and the negative pole of the left differential amplifier A2, and a second circuit, which is comprised of capacitor C3, variable resistor VRB2, capacitor C2 and resistor R2 connected in series between the left variable resistor VRA1 and the negative pole of the right differential amplifier A1. Therefore, differential amplifiers A1 and A2 both have a dual signal input, left sound channel signal is inputted into the right differential amplifier A1, and right sound channel signal is inputted into the left differential amplifier A2.

A stereo sound source (signal) is composed of "main sound" field, "background sound" field (synchronized music), and "sound-surround sound" field of the main sound field and the background sound field. The sound wave of "main sound" field is recorded in left/right sound source by means of "same phase". "Background sound" field and "sound-surround sound" field are recorded in left/right sound source by means of "different phase".

The technical measures and functions of the present invention are to "control main sound field", enabling the left main sound field to be phase-shifted and inputted into the right main sound field, and the right main sound field to be phase-shifted and inputted into the left main sound field, so that the left main sound field neutralizes the right main sound field, causing the sound-surround sound field to vary and the sound field contrast effect to be greatly improved.

Figure 1:
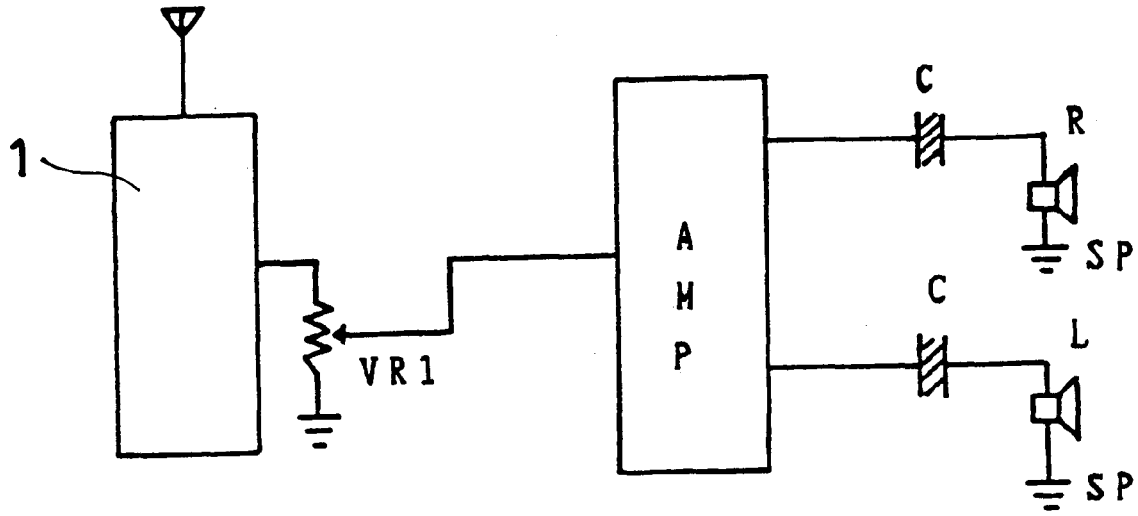
FIG.1 PRIOR ART
FIG. 1 is a circuit diagram of a wireless headphone/speakers sound field control circuit according to the prior art.
Figure 2:
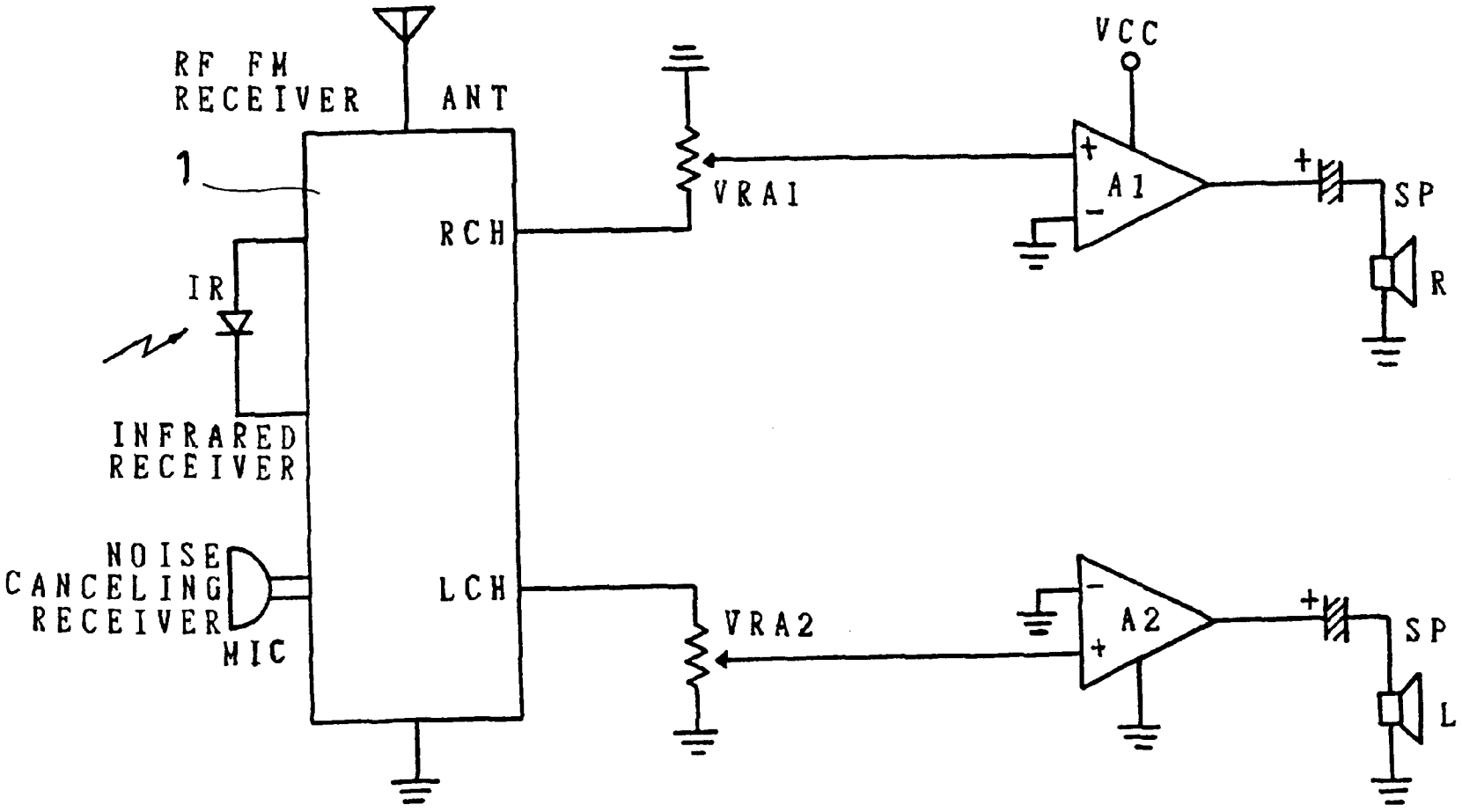
FIG. 2 PRIOR ART
FIG. 2 is a circuit diagram of another structure of wireless headphone/speakers sound field control circuit according to the prior art.
Figure 3:
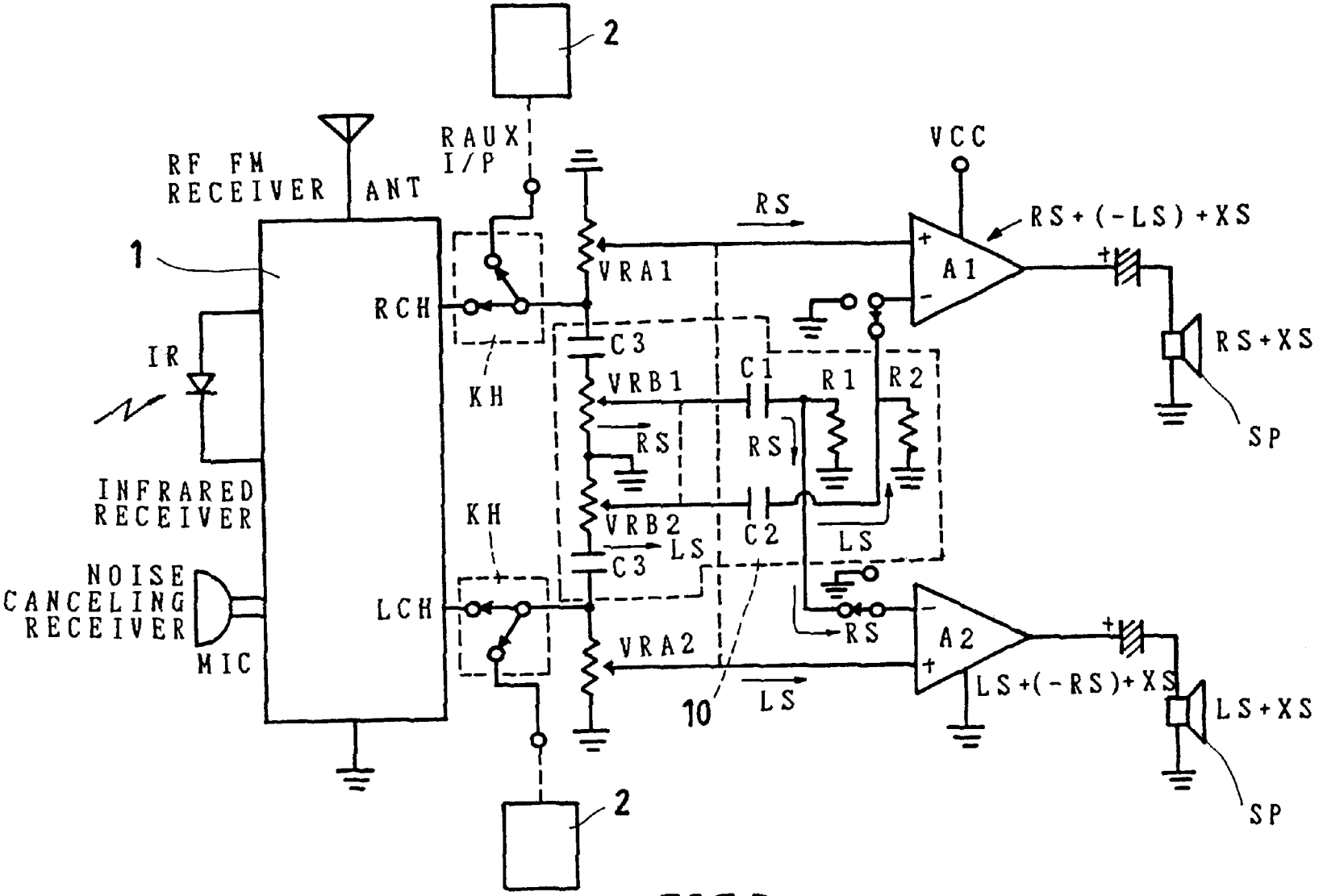
FIG. 3 is a circuit diagram of a wireless headphone/speakers sound field control circuit according to one embodiment of the present invention.
Figure 7:
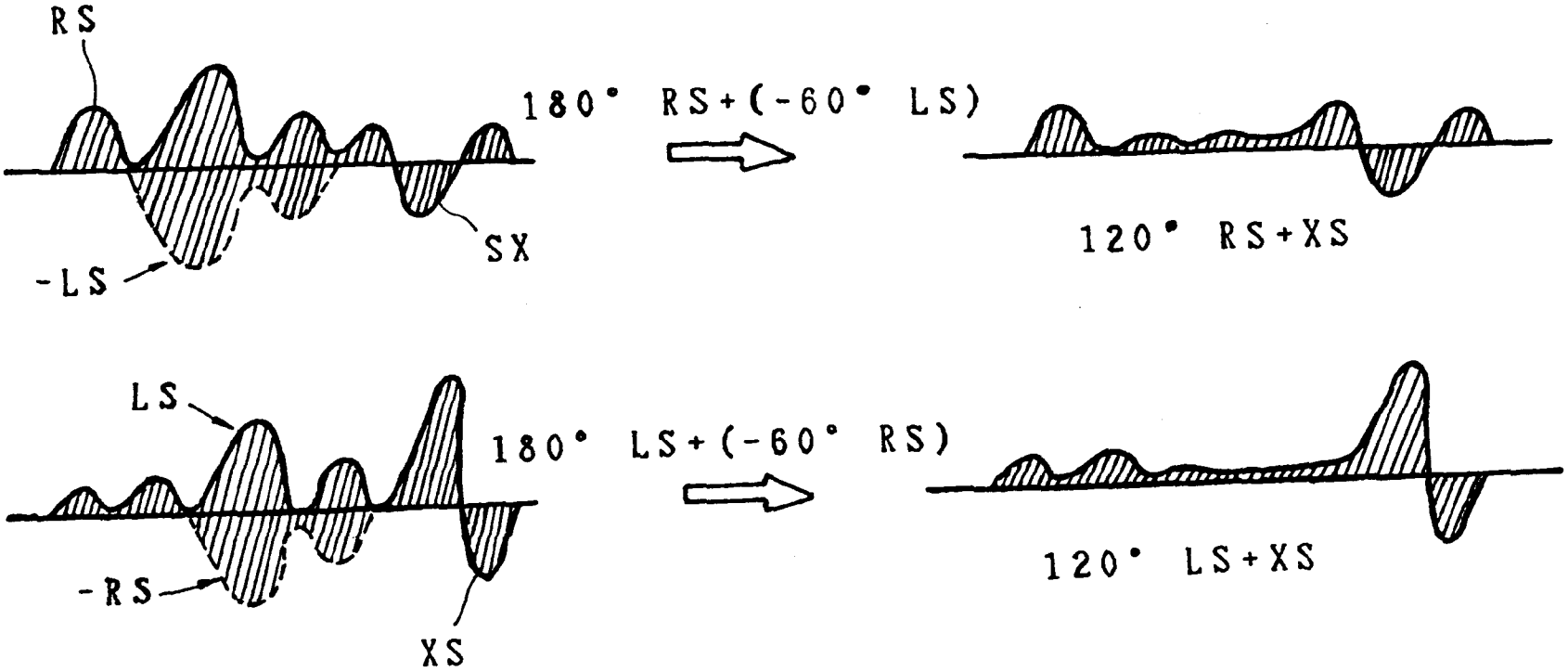
FIG. 7 is a schematic drawing showing the phase shifting of sound wave according to the present invention.

The operation and control of the present invention is outlined hereinafter with reference to FIGS. 3 and 7. Signals from the wireless signal receiver include left L and right R. One loop of the main sound field of the right sound channel RS (in right sound channel, there is also background sound, sound-surround sound) is directly inputted into the positive pole of the right differential amplifier A1. The other loop of the main sound field of the right sound channel RS is comprised of capacitor C3, variable resistor VRB1 and capacitor C1, and connected in series to the negative pole of the left differential amplifier A2, and forming with resistor R1 a RC phase-shifting circuit, enabling the main sound source of the right sound channel to be shunt to the other main sound field signal and inputted into the main sound field of the left sound channel under negative phase status. In the example shown in FIG. 7, the output of the left sound field LS is 180°LS+(−60°RS), forming an "offset effect", therefore the left sound channel speaker SP outputs sound 120°LS+XS (sound-surround sound field). In same manner, the right sound channel speaker obtains a phase-shifting effect through capacitor C3, capacitor C2, and resistor R2, showing the result of 180°RS+(−60°LS)+XS=120°RS+XS.

Therefore, the phase-shifting at the left main sound field neutralizes the phase-shifting at the right main sound field to reduce the main sound, so as to reinforce "sound-surround sound", achieving a stereo effect. The value of phase-shifting (off-set) can be adjusted through variable resistors VRB1 and VRB2. Variable resistors VRA1 and VRA2 are for volume control.

Figure 4:
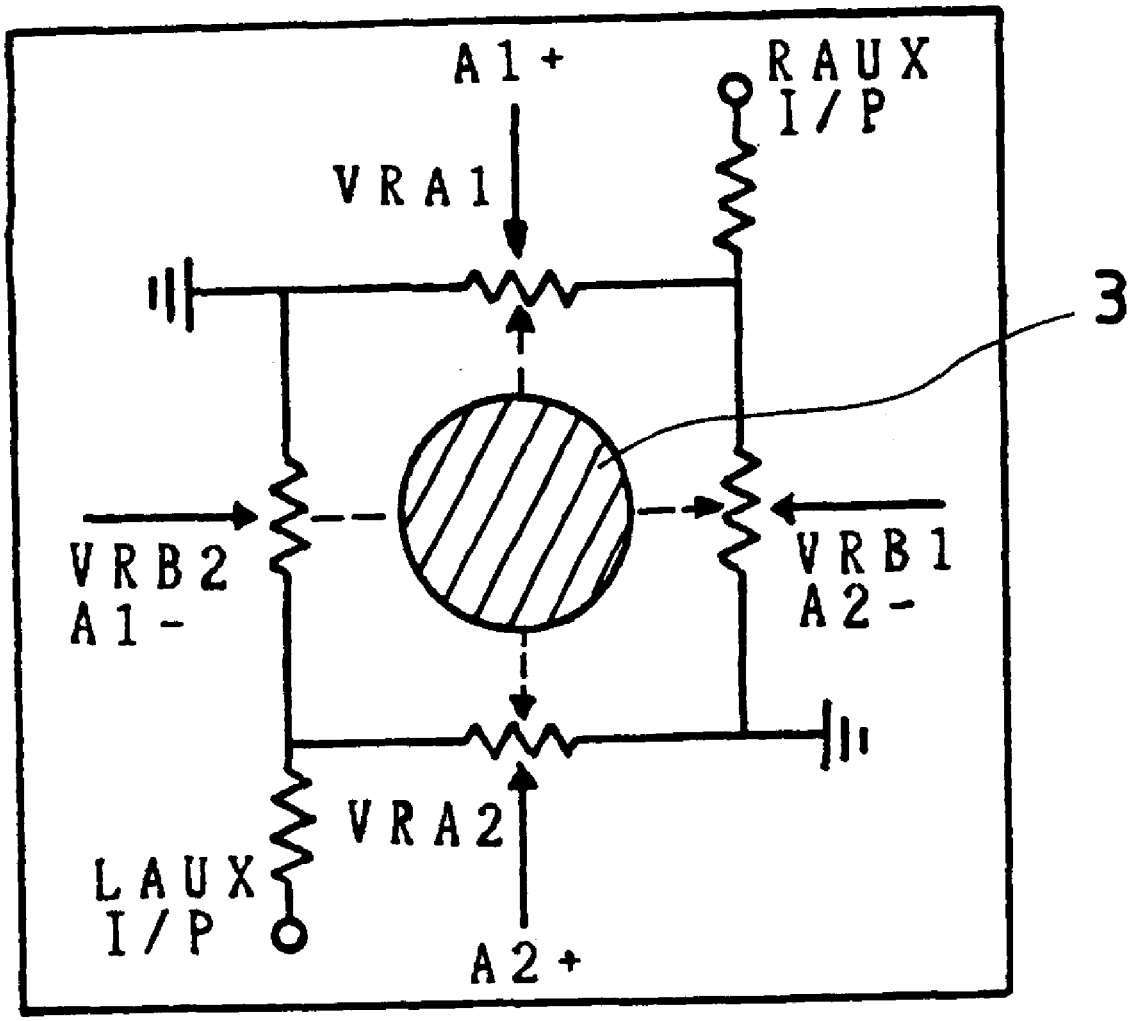
FIG. 4 is a circuit diagram of a part of an alternate form of the present invention, showing a joystick installed.
Figure 5:
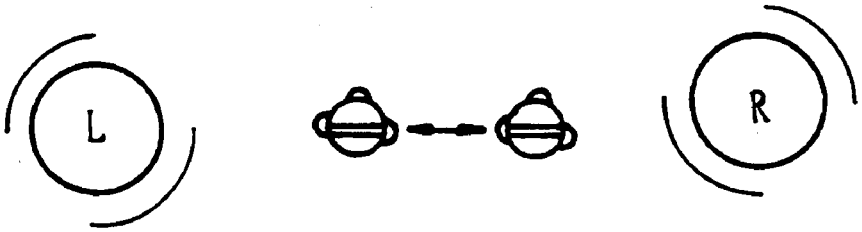
FIG.5 PRIOR ART
FIG. 5 is a schematic drawing showing the direction of sound field according to the prior art.
Figure 8:
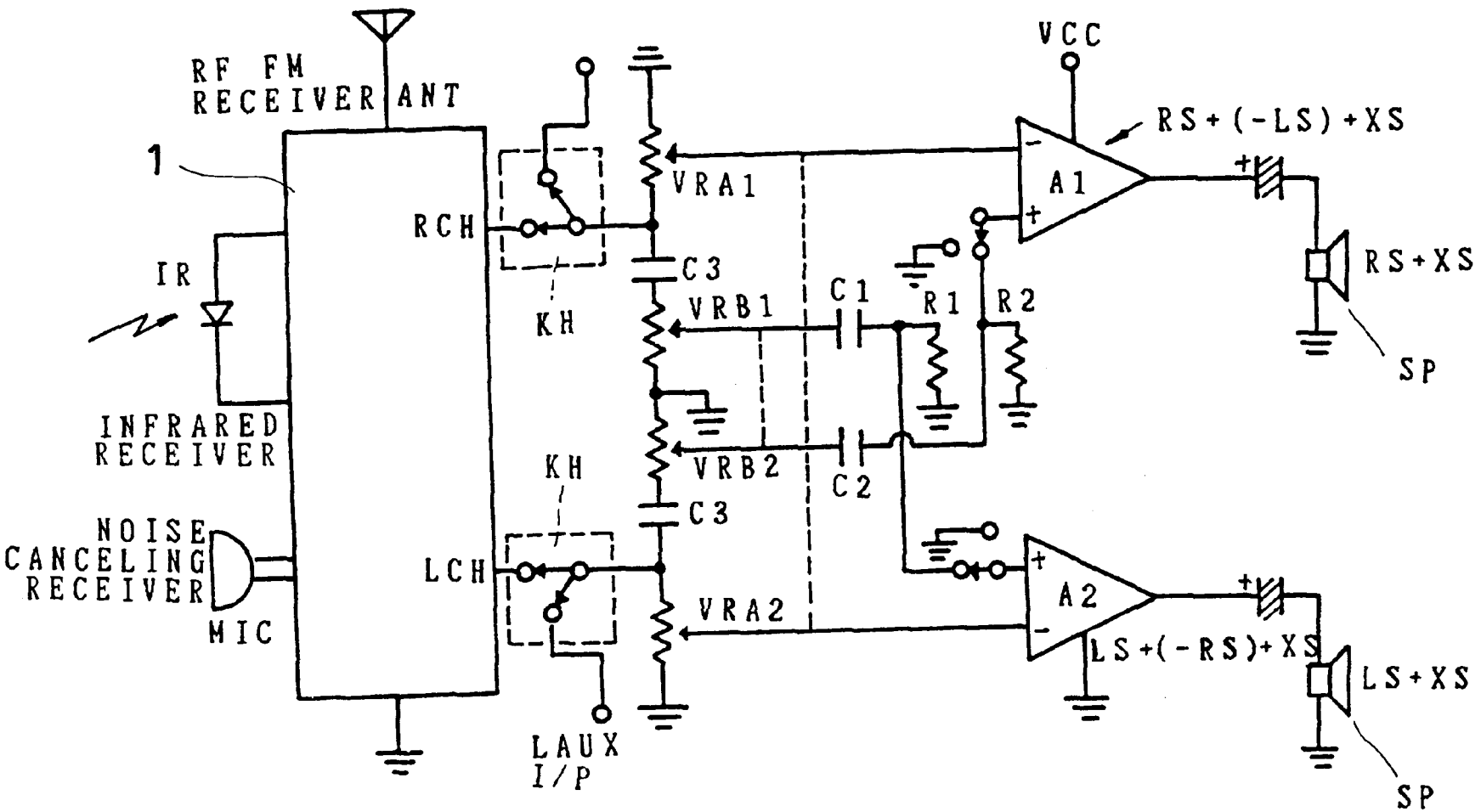
FIG. 8 is a circuit diagram of another alternate form of he present invention.

The present invention can be variously embodied in either of the following manners:

1. As illustrated in FIG. 3, a selector switch KH is switched between a first position where the wireless signal receiver 1 is connected to receive signal from for example a radio station or the main unit of an audio equipment, and a second position where the wireless signal receiver 1 is disconnected, and a second sound source 2 (for example, CD player, DVD player, tape recorder/player). This embodiment provides two receiving functions, namely, the wireless receiving function and the cabled receiving function.
2. As illustrated in FIG. 4, a joystick 3 is installed and turned to control the variable resistors VRA1, VRA2, VRB1 and VRB2, so as to control volume and sound field contrast.
3. As illustrated in FIG. 8, the phase-shifting circuit is connected to the positive pole of each of the differential amplifiers A1 and A2, i.e. reversed to the phase arrangement shown in FIG. 3.

Figure 6:
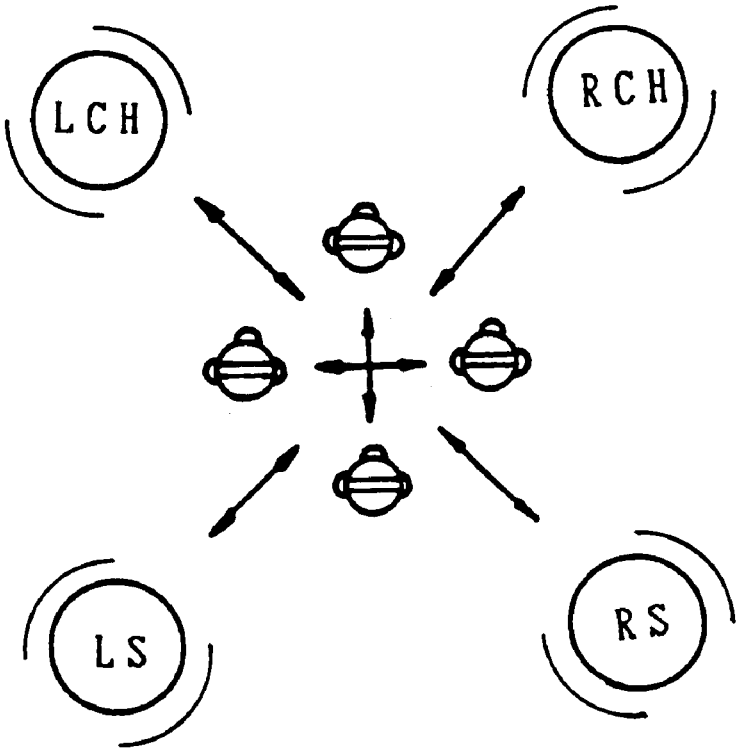
FIG. 6 is a schematic drawing showing the direction of sound field according to the present invention.

As indicated above, the present invention allows the user to conveniently adjust different sound field effect at the headphone or speakers. The depth of sound-surround sound field contains numberless direct and indirect sound waves, that produce a beat frequency effect. When different beat frequency come from different directions to the ears at different wave velocity, a contrast exists between the background sound and main sound, forming an lifelike sound-surround sound effect. The variable resistors VRB1 and VRB2 are directly installed in the headphone or speakers for convenient adjustment by the user steplessly to prevent an oppression at the ears. Because the main sound R or L of one of the two main sound channels receives sound signal of sound frequency phase-shifting over 180° from the other main sound channel, and received signal is steplessly adjusted and mixed in the main sound, the beat frequency signal produces a lifelike, multi-direction stereo effect as shown in FIG. 6.

It is to be understood that the drawings are designed for purposes of illustration only, and are not intended as a definition of the limits and scope of the invention disclosed.

What the invention claimed is:

1. A wireless headphone/speakers sound field control system comprising a wireless signal receiver, a left speaker connected to said wireless signal receiver through a left differential amplifier and a left variable resistor, and a right speaker connected to said wireless signal receiver through a right differential amplifier and a right variable resistor, said left variable resistor being connected to the positive pole of said left differential amplifier, said right variable resistor being connected to the positive pole of said right differential amplifier, wherein a phase-shifting circuit is connected between the negative pole of said left differential amplifier and the negative pole of said right differential amplifier, said phase-shifting circuit comprising a first circuit comprised of a first capacitor, a variable resistor, a second capacitor and a resistor, and connected in series between said right variable resistor and the negative pole of said left differential amplifier, and a second circuit comprised of a first capacitor, a variable resistor, a second capacitor, and a resistor connected in series between said left variable resistor and the negative pole of said right differential amplifier, said phase-shifting circuit enabling said differential amplifiers to have a dual signal input, so hat left sound channel signal is inputted into said right differential amplifier and right sound channel signal is inputted into the left differential amplifier to achieve a stereo effect.

2. The wireless headphone/speakers sound field control system of claim 1 further comprising a selector switch turned to connect/disconnect the circuit between said wireless signal receiver, and said right speaker and said left speaker.

3. A wireless headphone/speakers sound field control system comprising a wireless signal receiver, a left speaker connected to said wireless signal receiver through a left differential amplifier and a left variable resistor, and a right speaker connected to said wireless signal receiver through a right differential amplifier and a right variable resistor, said left variable resistor being connected to the positive pole of said left differential amplifier, said right variable resistor being connected to the positive pole of said right differential amplifier, wherein a phase-shifting circuit is connected between the positive pole of said left differential amplifier and the positive pole of said right differential amplifier, said phase-shifting circuit comprising a first circuit comprised of a first capacitor, a variable resistor, a second capacitor and a resistor, and connected in series between said right variable resistor and the positive pole of said left differential amplifier, and a second circuit comprised of a first capacitor, a variable resistor, a second capacitor, and a resistor connected in series between said left variable resistor and the positive pole of said right differential amplifier, said phase-shifting circuit enabling said differential amplifiers to have a dual signal input, so that left sound channel signal is inputted into said right differential amplifier and right sound channel signal is inputted into the left differential amplifier to achieve a stereo effect.

* * * * *